US005683338A

United States Patent [19]

Krasuski et al.

[11] Patent Number: 5,683,338

[45] Date of Patent: Nov. 4, 1997

[54] DEVICE FOR ASSISTING IN THE ADJUSTMENT OF FOLD DIMENSIONS IN A FOLDING AND INSERTING MACHINE

[75] Inventors: Marek Krasuski, Fontenay aux Roses; Dominique Mazeiller, La Frette, both of France

[73] Assignee: Neopost Industrie, Bagneux, France

[21] Appl. No.: 593,513

[22] Filed: Jan. 30, 1996

[30] Foreign Application Priority Data

Jan. 31, 1995 [FR] France ..... 95 01108

[51] Int. Cl.[6] ..... B31B 1/00

[52] U.S. Cl. ..... 493/23; 493/25; 493/37; 493/34; 493/420; 33/733; 53/504

[58] Field of Search ..... 33/732, 733, 719, 33/714, 715, 716; 53/504, 117; 493/37, 34, 25, 23, 476, 421, 420

[56] References Cited

U.S. PATENT DOCUMENTS

| | | | |
|---|---|---|---|
| 3,178,171 | 4/1965 | Springer et al. | 493/421 |
| 3,909,948 | 10/1975 | Markfelt | 33/716 |
| 4,701,233 | 10/1987 | Beck et al. | 493/421 |
| 5,242,364 | 9/1993 | Lehmann | 493/34 |
| 5,246,415 | 9/1993 | Fuss | 493/420 |
| 5,505,086 | 4/1996 | Sano et al. | 33/719 |

FOREIGN PATENT DOCUMENTS

| | | | |
|---|---|---|---|
| 0 156 326 A3 | 10/1985 | European Pat. Off. . | |
| 0 511 488 A1 | 11/1992 | European Pat. Off. . | |
| 1 564 392 | 4/1969 | France . | |
| 2 681 847 A1 | 4/1993 | France . | |
| 6473211 | 3/1989 | Japan | 33/754 |
| WO 93/15990 | 8/1993 | WIPO . | |

*Primary Examiner*—John Sipos
*Assistant Examiner*—Gene Kim
*Attorney, Agent, or Firm*—Sughrue,Mion,Zinn,Macpeak & Seas, PLLC

[57] ABSTRACT

A folder and inserter machine comprises a tray for receiving documents to be folded and a folding mechanism having a folding abutment whose position is adjustable under the control of a processor. A pointer member is moved along the document to be folded present in the tray to pick up the distance between the bottom of the document and an address block on the document. The processor connected to the pointer member is organized to compute data representative of fold dimensions for the document on the basis of the distance provided thereto by the pointer member so as to adjust the position of the abutment automatically.

3 Claims, 2 Drawing Sheets

DEVICE FOR ASSISTING IN THE ADJUSTMENT OF FOLD DIMENSIONS IN A FOLDING AND INSERTING MACHINE

The invention relates to the field of automatically folding and inserting documents in sheet form into envelopes.

BACKGROUND OF THE INVENTION

The invention relates more particularly to a folding and inserting machine comprising a tray for receiving documents to be folded and a folding mechanism fed with documents to be folded from the tray and having at least one folding abutment whose position is adjustable under the control of a processor.

One such machine is known from document FR 91/11992. In fact that machine has two feed trays, one for receiving the documents to be folded, and another for receiving the envelopes. It also comprises two folding pockets each provided with a movable folding abutment whose position is adjustable under the control of the processor. In accompanying FIG. 2, A and B correspond to two fold dimensions for a document that is to have two folds.

In the known machine of the above-mentioned document, the user inputs data representing the fold dimensions A and B into the machine by means of a keypad. An inexperienced user is not always capable of inputting the right data for a given document on the first attempt. In general, the user proceeds by successive approximations, running several attempts until satisfactory folding and insertion into an envelope are achieved.

OBJECT AND SUMMARY OF THE INVENTION

The object of the invention is to provide a device to enable the user to adjust fold dimensions for a document that is to be folded by a folding and inserting machine, while avoiding the need to proceed by successive approximations.

To this end, the invention provides a folding and inserting machine including a pointer member suitable for running along the full height of a document to be folded that is present in the tray and to provide a signal representative of the distance of its displacement along the height of the document. The processor is also connected to said pointer member to compute data representative of fold dimensions for the document on the basis of the signal provided by the pointer member so as to adjust the position of the abutment automatically.

BRIEF DESCRIPTION OF THE DRAWINGS

An embodiment of the invention is described in greater detail below with reference to the drawings.

MORE DETAILED DESCRIPTION

Figure 1:
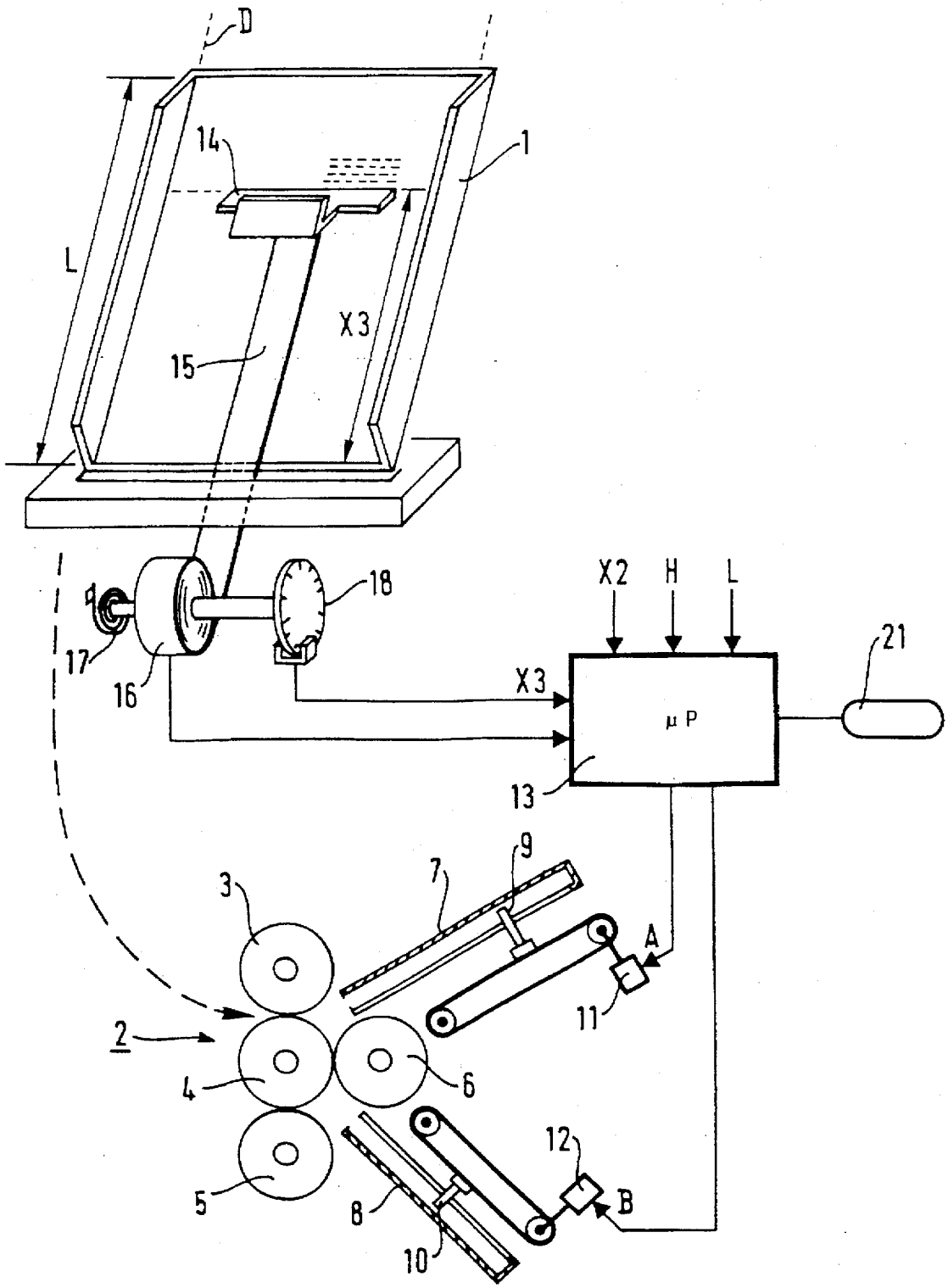
FIG. 1 is a diagram showing the components of a folding and inserting machine of the invention.

FIG. 1 shows a folding and inserting machine of the invention in highly simplified manner. It comprises a tray 1 for receiving documents to be folded and it feeds a folding mechanism 2 automatically with documents D via an inlet located beneath the tray 1.

The folding mechanism 2 includes a plurality of rollers 3, 4, 5, and 6 which drive the document to be folded into folding pockets, in this case two pockets 7 and 8. Each pocket is provided with a folding abutment 9 or 10 which is movable in translation along the inside of the pocket. The abutments are moved within the pockets under drive from motion transmission members 11 and 12 represented in the present case by endless belts driven by motors. Each abutment is displaced to take up a position corresponding to one of the fold dimensions of the document D to be folded.

Figure 2:
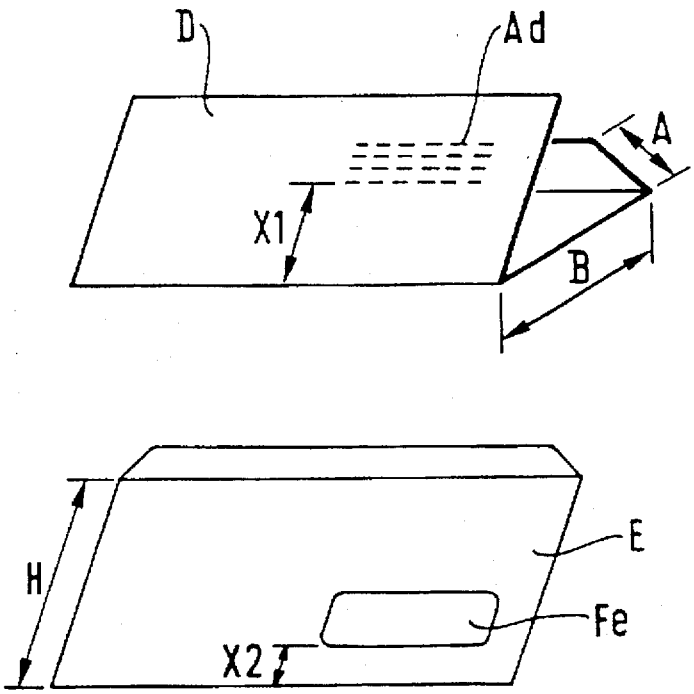
FIG. 2 shows a document having two folds for insertion into an envelope.

The motion transmission members are controlled by a processor 13 which supplies them with data A and B corresponding to two fold dimensions of a document to be folded. At this point it should be observed that the rollers insert each document D to be folded firstly into the pocket 7 where a fold is performed in application of dimension A shown in FIG. 2. Thereafter the rollers insert the folded document into pocket 8 where a second fold is performed in accordance with dimension B shown in FIG. 2.

According to the invention, a pointer member is provided which makes it easy to adjust automatically the positions of the fold abutments as a function of the types of document to be folded and the types of envelope into which the documents are to be inserted.

The pointer member comprises a bar 14 which extends across the width of the tray 1 (i.e. across the width of the document D in the tray 1). The bar is mounted to move in translation in the height direction of the tray 1 so as to slide along the full height L of the document D. For example, the bar may slide between two slideways provided on the sides of the tray 1.

The pointer member also includes a cable 15 which is connected at one end to the bar 14 and at its opposite end to a drum 16 on which it is wound. A spiral spring mounted on the rotary shaft of the drum 16 constrains the drum to wind in the cable 15 so as to bring the bar automatically down towards the bottom of the tray where it is retracted.

The bar 14 serves to define the position of the address block Ad on the document D relative to the bottom of the tray (i.e. relative to the bottom of the document D) by being pulled up the tray until it is placed immediately beneath the address block Ad on the document D, and the distance X3 through which the bar is displaced is picked up by a sensor 18 responsive to rotary displacement of the drum 16. By way of example, the sensor may be an incremental optical encoder suitable for providing the microprocessor 13 with a signal representative of the distance X3.

When the user releases the bar 14, it returns to the bottom of the tray under drive from the return spring acting on the drum and the cable.

The processor 13 is organized to compute data representative of the fold distances A and B on the basis of the distance X3 picked up from the sensor 18 and the dimension L corresponding to the height of the document D, the dimension H corresponding to the height of the envelope E in which the folded document D is to be inserted, and the dimension X2 corresponding to the distance between the bottom of the envelope E and the bottom of the window Fe in the envelope. The dimensions H and X2 are marked in FIG. 2. They are previously entered into the processor 13 by the user of the machine, e.g. by means of a keypad, or by a similar pointer system. As for the dimension H, it too may be input via the keypad or else picked up via a sensor that detects the passage of the leading edge and of the trailing edge of the document D and that takes account of the displacement speed of the document D. It may also be input by means of a similar position pointer.

By way of example, the processor is programmed to determine the fold dimensions A and B by solving the following system of equations:

$$X1=X2+5\ mm$$

$$B \leqq H-5\ mm$$

$$X1=X3-B-A$$

$$B \geqq A+3\ mm$$

$$L-A-B \leqq H-5\ mm$$

It should be understood that if a solution does not exist to the above system of equations, then the processor causes an appropriate help message to be displayed for the attention of the user.

Figure 3:
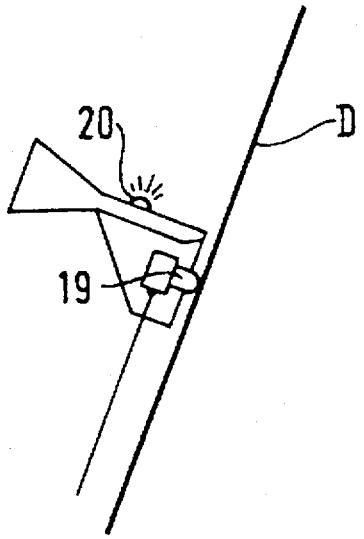
FIG. 3 is a diagram showing a detail of the pointer member of the invention.

According to the invention, the bar 14 is provided with a pressure sensor 19 visible in FIG. 3 which is connected to the processor 13 via an electrical link 15 in a flat cable replacing a simple wire. When the user moves the bar 14 up the height L of the document to be folded in the tray, the pressure sensor does not detect any pressure against the document. When the bar is positioned immediately below the address block Ad, the user presses the bar against the document and the pressure sensor delivers the signal which is then detected by the processor. It is thus easy to program the processor 13 so as to take account of the signal provided by the sensor 18 only when the pressure sensor is actuated.

Advantageously, the bar 14 carries a light-emitting diode (LED) 20 which is powered electrically by means of the electrical link 15. When the LED lights up, the user of the machine is informed that the machine is in an appropriate mode for providing assistance in adjusting the positions of the folding abutments. The processor is programmed to switch on the LED 20 after a menu item has been input or after a special key connected to the processor, e.g. the key 21, has been depressed. Thereafter, the user of the machine moves the bar 14 up the document to be folded as described above to input the dimension X3. Once that has been done, the processor computes the fold dimensions A and B so as to adjust the positions of the abutments 9 and 10 automatically.

We claim:

1. A folder and inserter comprising a tray for receiving documents to be folded, and a folding mechanism fed with documents from the tray and having at least one folding abutment whose position is adjustable under the control of a processor, wherein it is provided with a pointer member suitable for travelling up the entire height of a document to be folded and present in the tray, and for providing a signal representative of the distance it has moved along the height of the document, the processor also being connected to said pointer member to compute data representative of the fold dimensions of the document on the basis of the signal provided by the pointer member in order to adjust the position of the abutment automatically, wherein said pointer member comprises a bar extending across the width of the tray and mounted to move in translation along the tray up the height of the tray, a flexible link connected firstly to the bar and secondly to a drum on which it is wound, a return spring urging the drum to wind in the flexible link, and a sensor responsive to the rotary displacement of the drum, the sensor providing the signal representative of the distance through which the bar has moved up the height of the tray.

2. A folder and inserter according to claim 1, in which the bar is provided with a pressure sensor and the flexible link is an electrical link in the form of a flat cable connecting the pressure sensor to the processor.

3. A folder and inserter according to claim 2, in which the bar is provided with a light-emitting diode, and the processor is programmed to cause the diode to be switched on via the electrical link whenever displacement of the bar is effective in computing data representative of the fold dimensions of the document present in the tray.

* * * * *